United States Patent [19]

Salzer

[11] 3,959,875

[45] June 1, 1976

[54] METHOD AND FIXTURE FOR MANUFACTURING FUSES HAVING HELICALLY WOUND FUSIBLE ELEMENTS

[75] Inventor: Erwin Salzer, Waban, Mass.

[73] Assignee: The Chase-Shawmut Company, Newburyport, Mass.

[22] Filed: May 5, 1975

[21] Appl. No.: 574,542

[52] U.S. Cl. ..... 29/623; 29/203 J; 29/203 P; 29/614

[51] Int. Cl.[2] ..... H01H 69/02

[58] Field of Search ..... 29/203 J, 203 P, 203 R, 29/623, 618, 613, 614, 615, 619; 337/158, 159, 160

[56] References Cited

UNITED STATES PATENTS

| | | | |
|---|---|---|---|
| 1,927,905 | 9/1933 | Slepian et al. | 337/159 |
| 2,740,187 | 4/1956 | Jacobs, Jr. et al. | 29/623 |
| 2,740,189 | 4/1956 | Moore | 29/203 P |
| 3,839,786 | 10/1974 | Salzer | 29/623 |
| 3,846,728 | 11/1974 | Salzer | 337/159 |
| 3,848,214 | 11/1974 | Salzer | 29/623 X |
| 3,866,318 | 2/1975 | Kozacka | 29/623 |
| 3,881,161 | 4/1975 | Kozacka | 337/159 |

*Primary Examiner*—Victor A. DiPalma
*Attorney, Agent, or Firm*—Erwin Salzer

[57] ABSTRACT

A method for assembling fuses having casings closed by plug terminals conductively interconnected by helically wound fusible elements. The fusible elements are wound around squirrel-cage-like structures involving extremely thin and extremely stiff metal rods. These rods are withdrawn from the fusible elements and drawn out of the casings of the fuses at such time when the pulverulent arc-quenching filler filled into the casings provides sufficient support for the fusible elements so that the support thereof previously provided by the aforementioned metal rods can safely be dispensed with. The small diameter of the rods minimizes the voids initially formed by their removal which, in turn, minimizes the tendency of the fusible elements to be somewhat displaced incident to removal of their temporary metallic supporting rods.

A fixture for carrying the assembly process into effect includes means for the fixation of the ends of the supporting rods for the fusible elements that project beyond the plug terminals of the fuses.

10 Claims, 5 Drawing Figures

METHOD AND FIXTURE FOR MANUFACTURING FUSES HAVING HELICALLY WOUND FUSIBLE ELEMENTS

BACKGROUND OF THE INVENTION

This invention relates to improvements of the inventions disclosed and claimed in my Pat. Nos. 3,810,061, May 7, 1974, for HIGH-VOLTAGE FUSE and 3,848,214, Nov. 12, 1974, for METHOD OF ASSEMBLING ELECTRIC HIGH VOLTAGE FUSES AND SUBASSEMBLY THEREFOR.

The aforementioned patents refer to fuses having plug terminals, i.e. fuses wherein a tubular casing of electric insulating material is closed on both ends by cylindrical terminals inserted or press-fitted into it, and plugging the same. The plug terminals are conductively interconnected by substantially helically wound fusible element means, e.g. one or more ribbons of silver. These fusible element means are not supported by conventional mandrel structures of electric insulating material, e.g. a ceramic material, but their support is, in essence, effected by a pulverulent arc-quenching filler, e.g. quartz sand, forming a dense packing for the fusible element means which are embedded in it.

Manufacturing a fuse in accordance with the aforementioned Pat. 3,848,214 includes the steps of a. forming a squirrel-cage-like structure by a pair of cylindrical coaxially arranged and fixedly spaced plug terminals and a plurality of metal rods extending parallel to the joint axis of said pair of plug terminals;

b. winding fusible element means substantially helically around said plurality of metal rods and conductively connecting the ends thereof to said pair of plug terminals;

c. inserting said squirrel-cage-like structure with said fusible element means thereon in coaxial relation into a tubular casing of electric insulating material and affixing said casing to said pair of plug terminals;

d. filling said casing with a pulverulent arc-quenching filler through an aperture in one of said pair of plug terminals; and e. withdrawing said plurality of metal rods from said fusible element means and drawing said metal rods out of said casing at such time when said arc-quenching filler provides substantial support for said fusible element means, thus allowing to dispense with the metal rods previously providing the necessary support for the fusible element means.

The aforementioned metal rods may be removed sequentially or simultaneously after the casing has been filled substantially with pulverulent arc-quenching filler. As an alternative, filling of the casing with pulverulent arc-quenching filler and withdrawal of the supporting rods for the fusible element means may be effected in sequential increments of which each is less than the total length of the internal space inside the casing of the fuse.

It will be understood that whenever a metallic supporting rod for a fusible element is withdrawn from it and from the casing, a void is formed at the points heretofore occupied by the rod. Such voids are almost instantly filled with pulverulent arc-quenching filler which flows into them in liquid-like fashion. In order to achieve complete filling of the casing with pulverulent arc-quenching filler, to avoid any displacement of the fusible element means from their initial position incident to removal of their temporary metallic supporting rods and to minimize the time required to comply with these requirements it is necessary to minimize the voids resulting from the withdrawal of the metallic supporting rods for the fusible element means. This, in turn, makes it necessary to minimize the diameter of the supporting rods for the fusible elements. As a result of a reduction of their diameter, the temporary metallic supporting rods for the fusible element means have a tendency to undergo a deflection or to buckle.

It is the principal object of the present invention to minimize the diameter of the metallic supporting rods for the fusible element means and to minimize the deflection to which they are subjected by radial loads and by axial compression.

One means to achieve this end is disclosed in the above Pat. 3,810,061. It consists in an annular brace for the metal rod by which the fusible element means are supported temporarily. Long fuses for high voltage ratings, e.g. voltage ratings in excess of 15 kv, require an arrangement of several annular braces along the metallic supporting rods for their fusible elements. It is, therefore, another object of this invention to provide means which allow to dispense with annular braces as disclosed in Pat. 3,810,061, or to minimize the number thereof.

The aforementioned Pat. 3,848,214 shows supporting rods for the fusible element which are screw-threaded on one end. The screw-threaded ends of the aforementioned rods engage internally screw-threaded bores in one of the plug terminals. If the lengths of the threads on the rods and inside the bores are relatively short, the structure may lack dimensional stability. If the aforementioned length is increased, this results in a thickness of the plug terminals in excess of their functional requirements which consist in carrying current and properly sealing the casing of the fuse.

Affixing the metallic supporting rods for the fusible elements in blind screw-threaded bores in one of the plug terminals results in weakening of the ends of the supporting rods, which may be undesirable.

In order to minimize the diameter of the metallic supporting rods for the fusible elements these rods should be of a material which is as stiff as possible or has a Young's modulus which is as large as possible, e.g. tungstencarbide. Such materials can hardly be machined and thus cannot be provided with the screw-threads called for by Pat. 3,848,214.

The objects underlying the present invention include removal of all of the aforementioned limitations.

The Pats. 3,810,061 and 3,848,214 disclose a modification of the fuse manufacturing process wherein the blind bores in one of the plug terminals and the ends of the supporting rods which project into them need not be screw-threaded. In that particular modification a center post maintains the plug terminals of the fuse during a certain phase of the assembly process in fixed spaced relation, and the metal rods surrounding that center post perform merely the duty of supporting temporarily the fusible element or elements.

The presence of the aforementioned center post makes it more difficult to install a blown fuse indicator in the fuse. It is, therefore, another object of the present invention to provide a fuse assembly method by which the results achieved with the means disclosed in Pats. 3,810,061 and 3,848,214 can be achieved and can be surpassed without resorting to a center post, and which method allows convenient installation of a blown fuse indicator whenever desirable.

SUMMARY OF THE INVENTION

The process of manufacturing fuses in accordance with the present invention includes the following steps.

a. A pair of cylindrical plug terminals both having axial passageways open on both end surfaces thereof are arranged in coaxial spaced relation so that said passageways in one of said pair of plug terminals are in registry with said passageways in the other of said plug terminals.

b. A plurality of metal rods is threaded through said passageways in said pair of plug terminals in such a way that each of said plurality of rods projects with each end thereof beyond the axially outer end surface of each of said pair of plug terminals.

c. A pair of rod-clamping members having passageways is arranged in such a way that said passageways thereof are in registry with said passageways in said pair of plug terminals and that said rods project into said passageways in said pair of rod-clamping members.

d. Said rods are clamped against said passageways in said rod-clamping members so as to preclude relative movement between said rods and said rod-clamping members.

e. Fusible element means are wound substantially helically around said rods and the ends of said fusible element means are conductively connected to said pair of plug terminals.

f. A tubular casing is slid over one of said pair of clamping members into press-fitting engagement with said pair of plug terminals and said casing is affixed to said pair of plug terminals.

g. Said casing is filled with a pulverulent arc-quenching filler through registering apertures in one of said pair of rod-clamping members and in one of said pair of plug terminals.

h. Said rods are withdrawn from said fusible element means and drawn out of said casing at such point of time when said arc-quenching filler provides a substantial and sufficient support for said fusible element means.

DESCRIPTION OF PREFERRED EMBODIMENT

Figure 1:
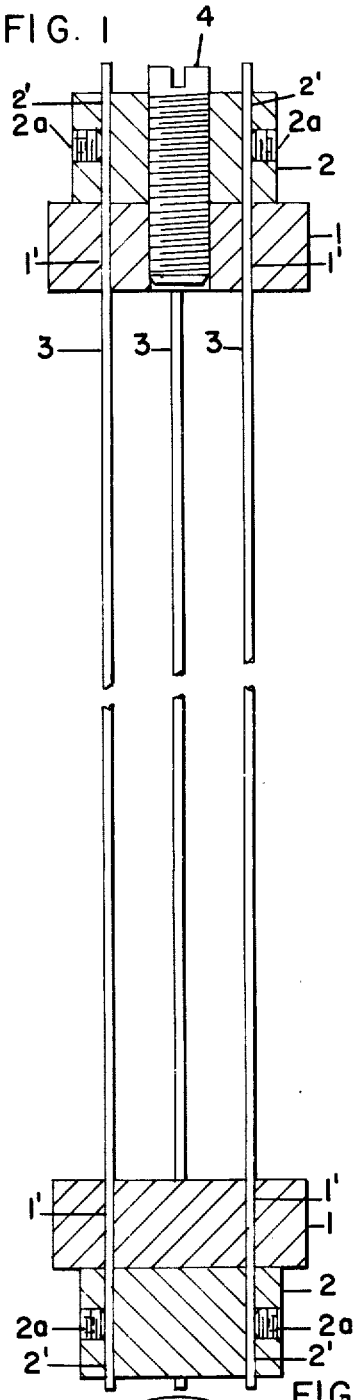
FIG. 1 is in part a side elevation and in part a section of a squirrel-cage-like structure or fixture used to manufacture fuses for elevated circuit voltages.
Figure 2:
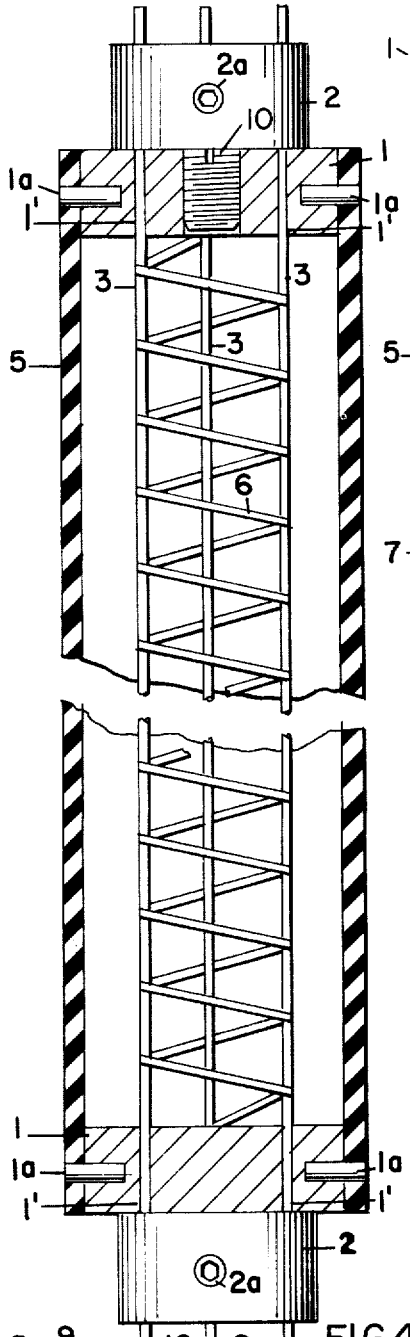
FIG. 2 shows the structure of FIG. 1 in part in side elevation and in part in vertical section in a more advanced stage of the manufacturing process than that shown in FIG. 1.
Figure 3:
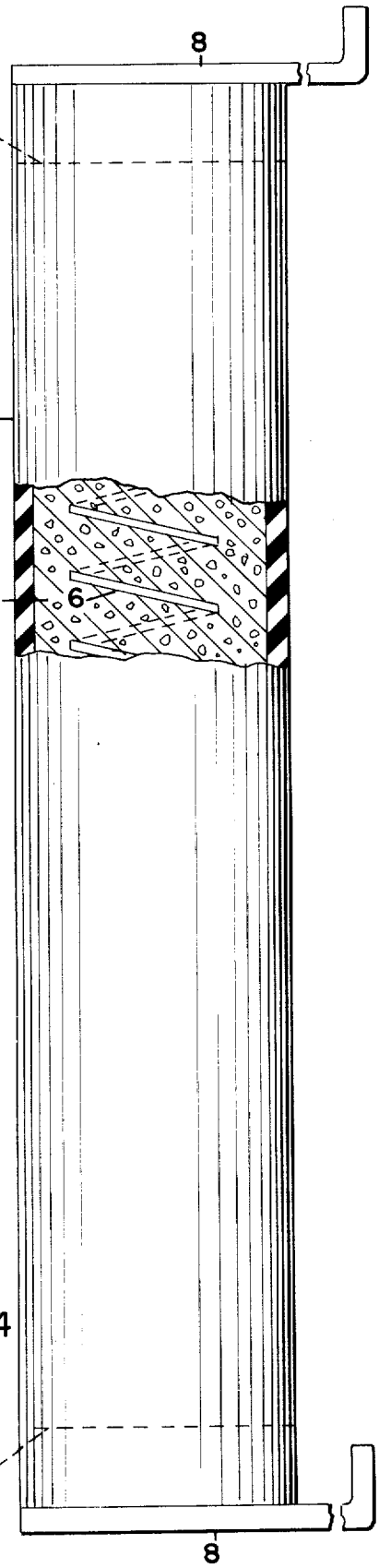
FIG. 3 shows in front elevation a complete fuse manufactured in accordance with the present invention with a portion of the casing thereof broken away to show the inside of the fuse.
Figure 1A:
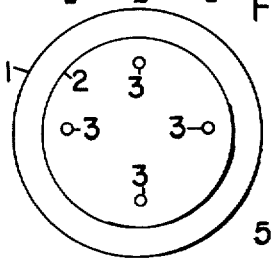
FIG. 1*a* is a bottom plan view of the structure shown in FIG. 1.
Figure 4:
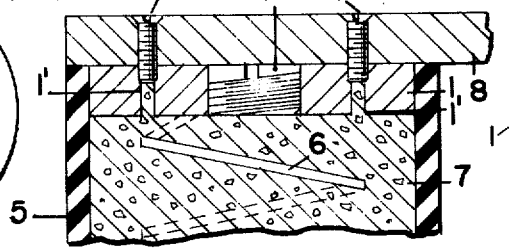
FIG. 4 shows mainly in vertical section a detail of the structure of FIG. 3 on a larger scale than FIG. 3.

Referring now to the drawings, numeral 1 has been applied to indicate a pair of cylindrical coaxially arranged fixedly spaced plug terminals and numeral 3 has been applied to indicate four metal rods, preferably of centerless ground tungsten carbide. Each plug terminal 1 is provided with four rod-receiving passageways 1' which are open on both end surfaces of each of plug terminals 1 so that rods 3 may project beyond said end surfaces. Rods 3 are not screw-threaded, nor are the axially inner ends of passageways 1' screw-threaded. The axially outer ends of passageways 1' may be screw-threaded as indicated in FIG. 4. One of a pair of rod-clamping members 2 is arranged adjacent the axially outer end surface of each plug terminal 1. Each rod-clamping member 2 is provided with four rod-receiving passageways 2'. Passageways 1' and 2' are arranged in registry. This allows to insert rods 3 into passageways 1' and 2' in such a way that they project out of both passageways 1' into both passageways 2'. Thereafter points of rods 3 inside passageways 2' are clamped against rod-clamping members 2, thus precluding relative movement between parts 2 and 3. The aforementioned clamping action may be effected by Allen wrench setscrews **2*a* of which four are arranged in each clamping member 2. These four set-screws are angularly displaced 90° and each of the four rods 3 is engaged by a pair of set-screws 2*a*. As shown in FIG. 1, members 1 and 2 are provided with a central bore which receives tie screw 4. Upon removal of tie screw 4 the passage freed by its removal may be used as a fuse filling aperture. Parts 1 and 2 are formed by coaxial cylinders, but parts 2 have a considerably smaller diameter than parts 1. When the structure shown in FIG. 1 is assembled a fusible element 6 is would helically around rods 3 and its ends are conductively connected to plug terminals 1. This preferably effected as disclosed in detail in U.S. Pat. 3,571,775, 03/23/71 to Frederick J. Kozacka et al for HIGH-VOLTAGE FUSE HAVING A PLURALITY OF HELICALLY WOUND RIBBON FUSE LINKS. After the structure of FIG. 1 has been provided with a fusible element 6 in ribbon form as shown in FIG. 2, the former is ready to be inserted into a tubular casing. This process step is shown in FIG. 2. Casing 5 may readily be slipped over lower rod-clamping member 2 since its diameter is smaller than that of lower plug terminal 1 and since none of the fasteners 2*a* for securing rods 3 to parts 2 project beyond the cylindrical space defined by the lateral surfaces of plug terminals 1. After casing 5 is positioned as shown in FIG. 2 it is affixed to plug terminals 1 by means of steel pins 1*a* projecting transversely through casing 5 into plug terminals 1. Thereupon screw 4 is removed from upper parts 1 and 2, thus exposing a central passageway for filling casing 5 with a pulverulent arc-quenching filler, e.g. quartz sand. After casing 5 is filled with filler 7 rods 3 may be withdrawn from fusible element 6 and drawn out of casing 5. This may be effected by lifting upper rod-clamping member 2 jointly with rods 3 after loosening lower set-screws 2*a*, but without loosening upper set-screws 2*a*. The axially outer ends of passageways 1' in both plug terminals 1 may be closed by screws 9 which perform the additional function of affixing connector straps 8 to the axially outer end surfaces of plug terminals 1. This has been clearly shown in FIG. 4**.

As shown in FIG. 4 the aperture in upper plug terminal 1 that has been exposed by removing screw-threaded stud 4 from it to allow casing 5 to be filled through it with pulverulent arc-quenching filler 7 is reclosed by a screw-threaded plug 10 after casing 5 has been filled with pulverulent arc-quenching filler 7. Upon withdrawal of rods 3 from the structure of FIG. 2 the level of the pulverulent arc-quenching filler 7 in casing 5 undergoes a slight decrease. This decrease is very slight on account of the smallness of the volume occupied by rods 3. It is, however, desirable following removal of rods 3 to add a small amount of pulverulent arc-quenching filler to casing 5 before closing the same permanently by means of screw-threaded plug 10.

It will be noted that rod-clamping members 2 are arranged in abutting relation to plug terminals 1 which precludes the latter from sliding axially outwardly along rods 3. As long as it is in position screw-threaded plug 4 precludes upper terminal plug 1 from moving downwardly along rods 3.

Set-screws 2*a* are positioned radially with respect to plug terminals 1 and rod-clamping members 2 are preferably formed by cylindrical metal blocks of which at least the lower one has a smaller diameter than that of plug terminals 1.

It will be apparent from the above that each rod 3 is fixed or braced at its ends at two immediately adjacent regions, i.e. inside passageways 1' in plug terminals 1 and inside passageways 2' inside clamping members 2. The total length of the regions where rods 3 are fixed or braced by far exceeds the thickness of plug terminals 1. This tends to minimize the flexure of rods 3 as a result of the loading thereof by fusible element 6 and flexure or buckling thereof as a result of compressive forces. It will further be apparent that the mechanical integrity of rods 3 is not impaired at any point or points thereof by the presence of screw-threads thereon. Rods 3 fit relatively tightly into passageways 1' in plug terminals 1 and into the axially inner non-screw-threaded ends of passageways or bores 2' in rod-clamping members 2.

It will be understood that it is necessary to prevent the outflow of pulverulent arc-quenching filler 7 through passageways 1' and 2' in lower parts 1 and 2 incident to withdrawal of rods 3 from winding 6 and casing 5. The tendency of outflow of arc-quenching filler is relatively small where the particles of filler are relatively large and the diameter of passageways 1' and 2' relatively small. There is a number of ways of preventing outflow of arc-quenching filler 7 through the aforementioned passageways. It is, for instance, possible to withdraw rods 3 in two consecutive stages or steps of which the first step or stage consists in withdrawing rods 3 only so far as to clear the passageways 2' in lower part 2 and to clear the axially outer ends of passageways 1' in lower plug terminal 1 so that the axially inner ends of passageways 1' in lower plug terminal 1 still remain plugged by rods 3. Then the entire structure is reversed to an upside-down position, so that the parts 1, 2 that heretofore were at a relatively high level are at a relatively lower level, and vice versa. Then the passageways 1' in terminal plug 1 heretofore at the lower but now at the upper level can be plugged by plug-screws 9, and simultaneously one of the terminal straps 8 affixed to that terminal plug 1. Thereafter the entire structure is again reversed and rods 3 are fully withdrawn from fusible element 6 and drawn out of casing 5.

An alternative process involves the steps of plugging the passageways 1' in lower plug terminal 1 from below by special plug rods (not shown) while withdrawing rods 3 in upward direction from helical winding 6 and pulling rods 3 out of casing 5.

Still another alternative for preventing outflow of pulverulent arc-quenching filler 7 through passageways 1' in lower plug terminal 1 consists in inserting a perforated sheet of an elastomer, e.g. vulcanized rubber, between the abutting surfaces of lower parts 1 and 2. The perforations in such a sheet allow the passage of rods 3 through them, but are self-sealing and thus preclude the outflow of arc-quenching filler 7 through passageways 1' in lower plug terminal 1. The latter alternative requires the provision of an additional fastener, e.g. of an axially extending screw, to affix the lower part 2 to the lower plug terminal 1 while rods 3 are withdrawn from parts 5 and 6. This additional fastener is necessary because the set-screws 2*a* in lower part 2 must be loosened to allow the withdrawal of rods 3 from parts 5 and 6. The last mentioned alternative calls for a final reversal of the fuse structure for plugging by plug screws 9 the passageways 1' in lower plug terminal 1 which has been sealed heretofore by the aforementioned elastomeric sheet.

I claim as my invention:

1. A process for manufacturing fuses for elevated circuit voltages including the steps of a. arranging a pair of cylindrical plug terminals both having axial passageways open on both end surfaces thereof in coaxial spaced relation so that said passageways in one of said pair of plug terminals are in registry with said passageways in the other of said pair of plug terminals;

b. threading a plurality of metal rods through said passageways in said pair of plug terminals in such a way that each of said plurality of rods projects with each end thereof beyond the axially outer end surface of each of said pair of plug terminals;

c. arranging a pair of rod-clamping members having passageways in such a way that said passageways thereof are in registry with said passageways in said pair of plug terminals and that said rods project into said passageways in said pair of rod-clamping members;

d. clamping said rods against said passageways in said rod-clamping members so as to preclude relative movement between said rods and said rod-clamping members;

e. winding fusible element means substantially helically around said rods and conductively connecting the ends of said fusible element means to said pair of plug terminals;

f. sliding a tubular casing over one of said pair of clamping members into press-fitting engagement with said pair of plug terminals and affixing said casing to said pair of plug terminals;

g. filling said casing with a pulverulent arc-quenching filler through registering apertures in one of said pair of rod-clamping members and in one of said pair of plug terminals; and h. withdrawing said rods from said fusible element means and drawing said rods out of said casing at such point of time when said arc-quenching filler provides substantial and sufficient support for said fusible element means.

2. A process as specified in claim 1 including the steps of arranging each of said pair of rod-clamping members in abutting relation to one of said pair of plug terminals, and of affixing one of said pair of plug terminals to one of said pair of rod-clamping members to preclude relative movement between said one of said pair of plug terminals and said one of said pair of rod-clamping members.

3. A process of manufacturing fuses for elevated circuit voltages wherein a squirrel-cage-like structure is formed by a pair of cylindrical, coaxially arranged and fixedly spaced plug terminals and a plurality of metal rods extending parallel to the joint axis of said pair of plug terminals; fusible element means are wound substantially helically around said plurality of metal rods and conductively connected with the ends thereof to said pair of plug terminals, said squirrel-cage-like structure with said fusible element means thereon is inserted in coaxial relation into a tubular casing affixed to said pair of plug terminals and is filled with a pulverulent arc-quenching filler through an aperture in one of said pair of plug terminals and said plurality of metal rods are withdrawn from said fusible element means and drawn out of said casing at such time when said arc-quenching filler provides substantial and sufficient support for said fusible element means, wherein the improvement comprises the steps of a. providing each of said pair of plug terminals with rod-receiving passageways open on both end surfaces of each of said pair of plug terminals;

b. arranging one of a pair of rod-clamping members adjacent the axially outer end surface of each of said pair of plug terminals and registering rod-receiving passageways in each of said pair of rod-clamping members with said rod-receiving passageways in said pair of plug terminals;

c. inserting a plurality of metal rods into said rod-receiving passageways of said plug terminals in such a way that the ends of said plurality of rods project into said rod-receiving passageways in each of said pair of rod-clamping members;

d. clamping the points of said plurality of rods inside said rod-receiving passageways of said pair of rod-clamping members against said pair of rod-clamping members; and e. sliding a tubular casing over one of said pair of rod-clamping members into firm engagement wth said pair of plug terminals.

4. A fixture for manufacturing fuses having helically wound fusible elements including a. a pair of cylindrical plug terminals;

b. a pair of rod-clamping members, at least one of said pair of rod-clamping members being arranged inside of the cylindrical space defined by the lateral surfaces of said pair of plug terminals;

c. metal rods having non-screw-threaded surfaces projecting through registering passageways in said pair of plug terminals into registering passageways in said pair of rod-clamping members;

d. fasteners affixing said pair of rod-clamping members to said rods to preclude relative movement between said pair of rod-clamping members and said rods;

e. at least the fasteners affixing one of said pair of rod-clamping members to said rods being wholly arranged inside said cylindrical space defined by the lateral surfaces of said pair of plug terminals; and f. means for affixing the other of said pair of rod-clamping members to one of said pair of plug terminals positioned immediately adjacent thereto to preclude relative movement between said one of said pair of plug terminals and said rods.

5. A fixture as specified in claim 1 wherein said rods are of a metal having a larger Young's modulus than steel.

6. A fixture as specified in claim 5 wherein said rods are of tungsten carbide.

7. A fixture as specified in claim 4 wherein said fasteners are formed by set-screws being arranged inside said pair of clamping members and positioned radially with respect to said pair of plug terminals.

8. A fixture as specified in claim 4 wherein said pair of rod-clamping members is formed by a pair of cylindrical metal blocks having smaller diameters than said pair of plug terminals.

9. A fixture as specified in claim 4 wherein said passageways in said pair of rod-clamping members are non-screw-threaded and said passageways in said pair of plug terminals are screw-threaded at their axially outer ends thereof.

10. A fixture as specified in claim 4 wherein said other of said pair of rod-clamping members and said one of said pair of plug terminals positioned immediately adjacent thereto are provided with aligned internally screw-threaded bores and affixed to each other by an externally screw-threaded stud extending through said bores.

* * * * *